US007239827B2

(12) United States Patent
Furukawa

(10) Patent No.: US 7,239,827 B2
(45) Date of Patent: Jul. 3, 2007

(54) IMAGE FORMING DEVICE THAT PREVENTS REVERSE TRANSFER AND COLOR MIXTURE

(75) Inventor: Toshio Furukawa, Nagoya-shi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 89 days.

(21) Appl. No.: 11/092,675

(22) Filed: Mar. 30, 2005

(65) Prior Publication Data

US 2005/0220489 A1 Oct. 6, 2005

(30) Foreign Application Priority Data

Mar. 31, 2004 (JP) ..... 2004-105503
Dec. 8, 2004 (JP) ..... 2004-355933

(51) Int. Cl.
*G03G 21/00* (2006.01)

(52) U.S. Cl. ..... 399/149; 399/53; 399/71; 399/99

(58) Field of Classification Search ..... 399/149, 399/150, 71, 53, 101, 343, 358, 99
See application file for complete search history.

(56) References Cited

U.S. PATENT DOCUMENTS 6,952,547 B2 * 10/2005 Watanabe et al. ..... 399/149
2003/0147669 A1 * 8/2003 Kakeshita ..... 399/149
2004/0038142 A1 * 2/2004 Yoshida et al. ..... 430/108.6

FOREIGN PATENT DOCUMENTS

JP B2 3248047 11/2001

* cited by examiner

*Primary Examiner*—Sophia S. Chen
(74) *Attorney, Agent, or Firm*—Oliff & Berridge, PLC

(57) ABSTRACT

In a color laser printer, the amount of reversely transferred developing agent on the surface of a developing roller is estimated based on the operating time of the color laser printer, the surface area of an image, and the charging amount of developing agent. When the estimated amount of reversely transferred developing agent reaches a predetermined value, a solid image is formed on a photoconductor drum. By transferring the solid image onto recording paper, a conveyer belt, or an intermediate transfer belt, the reversely transferred developing agent is removed. Alternatively, by rotating the developing roller in a state in which the developing roller is separated from the photoconductor drum, the reversely transferred developing agent on the surface of the developing roller is collected into a developing agent hopper.

22 Claims, 11 Drawing Sheets

IMAGE FORMING DEVICE THAT PREVENTS REVERSE TRANSFER AND COLOR MIXTURE

CROSS-REFERENCE TO RELATED APPLICATIONS

This application claims the benefit of Japanese Patent Application No. 2004-105503 filed Mar. 31, 2004 and Japanese Patent Application No. 2004-355933 filed Dec. 8, 2004 in the Japanese Patent Office, the disclosures of which are incorporated herein by reference.

BACKGROUND

The present invention relates to an image forming apparatus, such as a cleanerless color laser printer, configured to collect and reuse a developing agent.

In a color laser printer, a color image as obtained by forming an electrostatic latent image on a photoconductor drum, applying developing agents of a plurality of colors to the photoconductor drum with developing rollers to form developing agent images, and then sequentially transferring the developing agent images onto a transfer target medium, such as recording paper or an intermediate transfer belt. During transfer of the developing agent images in such a color laser printer, so-called reverse transfer sometimes occurs. Reverse transfer is a phenomenon that part of the developing agent already transferred onto the transfer target medium is transferred from the transfer target medium onto the photoconductor drum. Occurrence of reverse transfer leads to a problem that the reversely transferred developing agent is mixed with a developing agent of a color to be originally transferred from the photoconductor drum at the next image formation, which results in color mixture and thereby a deteriorated quality of a color image to be formed.

To prevent such a problem, a technique has been presented, in which a property that reverse transfer depends on the ratio (the coverage) of a surface area of the developing agent covered with an outer additive to a surface area of developing agent particles is utilized. Specifically, color mixture due to reverse transfer is prevented in order to obtain an image without undesirable changes in color, by appropriately adjusting the ratio of a surface area of spherical developing agent particles covered with an outer additive to a surface area of the spherical developing agent particles, or appropriately adjusting the shapes of spherical developing agent particles (the deviation from spheres and the unevenness of the particle surfaces).

An example of such a technique is disclosed in the Publication of Japanese Patent No. 3248047.

SUMMARY

However, the above technique, which may prevent reverse transfer only when a developing agent having particles of a particular shape or a particular structure is used, will lead to a problem that available developing agents are limited.

The present invention, which has been made in view of problems such as the above, has an object to obtain an improved color image to be formed by preventing color mixture of developing agents during transfer without any limitation to the shape or the structure of developing agent particles.

In one aspect of the present invention made for attaining the above object, there is provided an image forming apparatus which comprises: at least one image carrier that carries an electrostatic latent image; an electrostatic latent image Forming device that forms an electrostatic latent image on a surface of the image carrier; a plurality of developing devices, each having a developing agent carrier, each of the plurality of developing devices applying the developing agent on the surface of the image carrier on which the electrostatic latent image is formed by the electrostatic latent image forming device such that a developing agent image is formed on the surface of the image carrier; a transfer device that transfers the developing agent image on the surface of the image carrier formed by each of the plurality of developing devices onto a transfer target medium, a part of the developing agent transferred to the transfer target medium being reversely transferred from the transfer target medium to the image carrier and being collected on a surface of the developing agent carrier; a reversely transferred developing agent amount estimating device that estimates each amount of the reversely transferred developing agent on the surface of the developing agent carrier; and a reversely transferred developing agent removing device that removes the collected reversely transferred developing agent from the surface of the developing agent carrier when the amount of the reversely transferred developing agent estimated by the reversely transferred developing agent removing device exceeds a predetermined value.

According to the image forming apparatus as above, the reversely transferred developing agents collected on the surfaces of the developing agent carriers can be removed. It is, therefore, possible to prevent color mixture in the image forming apparatus, thereby to achieve an improved quality of a color image to be formed.

It is also possible to minimize consumption of the developing agent since removal of the reversely transferred developing agents is not performed until when the amount of the reversely transferred developing agent estimated by the reversely transferred developing agent amount estimating device exceeds the predetermined value.

The reversely transferred developing agent may be removed from the developing agent carrier included in the developing device by transferring the reversely transferred developing agent from the developing agent carrier onto the transfer target medium through the image carrier, or by transferring the collected reversely transferred developing agent from the developing agent carrier to a developing agent container.

When the transfer target medium is a recording medium, the entire surface of the image carrier is exposed and so-called solid printing is performed in order to transfer the reversely transferred developing agent onto the recording medium through the image carrier. Then, the reversely transferred developing agent collected on the surface of the developing agent carrier is attached to the image carrier and is subsequently transferred onto the recording medium at a transfer portion.

The reversely transferred developing agent also may be removed by transferring the reversely transferred developing agent onto a moving body for conveying the recording medium. In the case of transferring the reversely transferred developing agent onto the moving body, the reversely transferred developing agent will spoil a recording medium at the next image formation. To prevent this from happening, it is preferable to provide a reversely transferred developing agent collecting device to the moving body to collect the reversely transferred developing agent attached to the moving body. Alternatively, a collection device for removing a calibration pattern printed on the moving body may be designed to also serve as the reversely transferred developing agent collecting device.

In an image forming apparatus provided with an intermediate transfer body, it may be possible to remove the reversely transferred developing agent by transferring the reversely transferred developing agent onto the intermediate transfer body.

Such an image forming apparatus provided with an intermediate transfer body is usually also provided with a developing agent collecting device (a cleaning device) that collects developing agents remaining on the intermediate transfer body after transfer onto a recording medium. Accordingly, reversely transferred developing agents removed by transfer onto the intermediate transfer body may be collected by the developing agent collecting device.

When reversely transferred developing agents are removed in the above described manners, a recording medium will not be spoiled at the next image formation.

In the case of removing reversely transferred developing agents by transfer onto a recording medium, a moving body, or an intermediate transfer body, it is not always necessary to remove the reversely transferred developing agents attached to the developing devices at the same time since the amounts of the reversely transferred developing agents attached to the respective developing devices are different from one another. Specifically, only with respect to a developing device having an amount of reversely transferred developing agent exceeding a predetermined value, the reversely transferred developing agent attached to the developing device is transferred onto a recording medium, a moving body, or an intermediate transfer body through the image carrier.

In this case, in a tandem image forming apparatus provided with a plurality of image carriers, reversely transferred developing agent transferred onto a recording medium, a moving body, or an intermediate transfer body may be again transferred onto other image carriers on the downstream side.

Accordingly, in an image forming apparatus including a plurality of image carriers corresponding to a plurality of developing devices, the reversely transferred developing agent removing device is preferably provided with a separating device that separates image carriers, corresponding to developing devices other than a developing device having an amount of reversely transferred developing agent exceeding the predetermined value, from the moving body, or the intermediate transfer body.

According to the image forming apparatus as above, it is possible to surely prevent reversely transferred developing agents from being again transferred onto image carriers corresponding to developing devices which do not require removal of reversely transferred developing agents.

In another aspect of the present invention, the reversely transferred developing agent may be removed from the developing agent carrier by collecting the reversely transferred developing agent from the developing agent carrier to the developing agent container. In this case, the reversely transferred developing agent is collected to the developing agent container by actuating the developing device in a state in which developing agent is not applied to the image carrier, that is, in which no latent image is formed. Accordingly, consumption of the developing agent can be minimized, in contrast to the case of removing the reversely transferred developing agent by transfer onto a recording medium through the image carrier.

When only the developing agent carrier is actuated while maintaining abutment of the developing agent carrier with the image carrier, the developing agent as well as the developing agent carrier and the image carrier are deteriorated.

In a further aspect of the present invention, therefore, the reversely transferred developing agent removing device preferably includes a separating device. When the amount of the reversely transferred developing agent collected by at least one developing device of the plurality of developing devices exceeds the predetermined value, the separating device separates at least one developing agent carrier corresponding to the at least one developing device from at least one image carrier corresponding to the at least one developing device. The reversely transferred developing agent on the developing agent carrier is collected to the developing agent container while the developing agent carrier is separated from the image carrier by the separating device.

In a still further aspect of the present invention, the reversely transferred developing agent amount estimating device preferably estimates the amount of the reversely transferred developing agent with respect to at least one developing device in the second or later place in order of image formation among the developing devices by using, as a parameter, at least one of: a difference in charging capacity between a developing agent of the at least one developing device and a developing agent of a developing device performing development earlier than the at least one developing device, a surface area of an image formed with the developing agent of the developing device performing development earlier than the at least one developing device, and an operating time of the at least one developing device.

BRIEF DESCRIPTION OF THE DRAWINGS

A preferred embodiment of the present invention will be described hereinafter with reference to the drawings, in which.

DETAILED DESCRIPTION OF THE PREFERRED EMBODIMENT

First Embodiment

Figure 1:
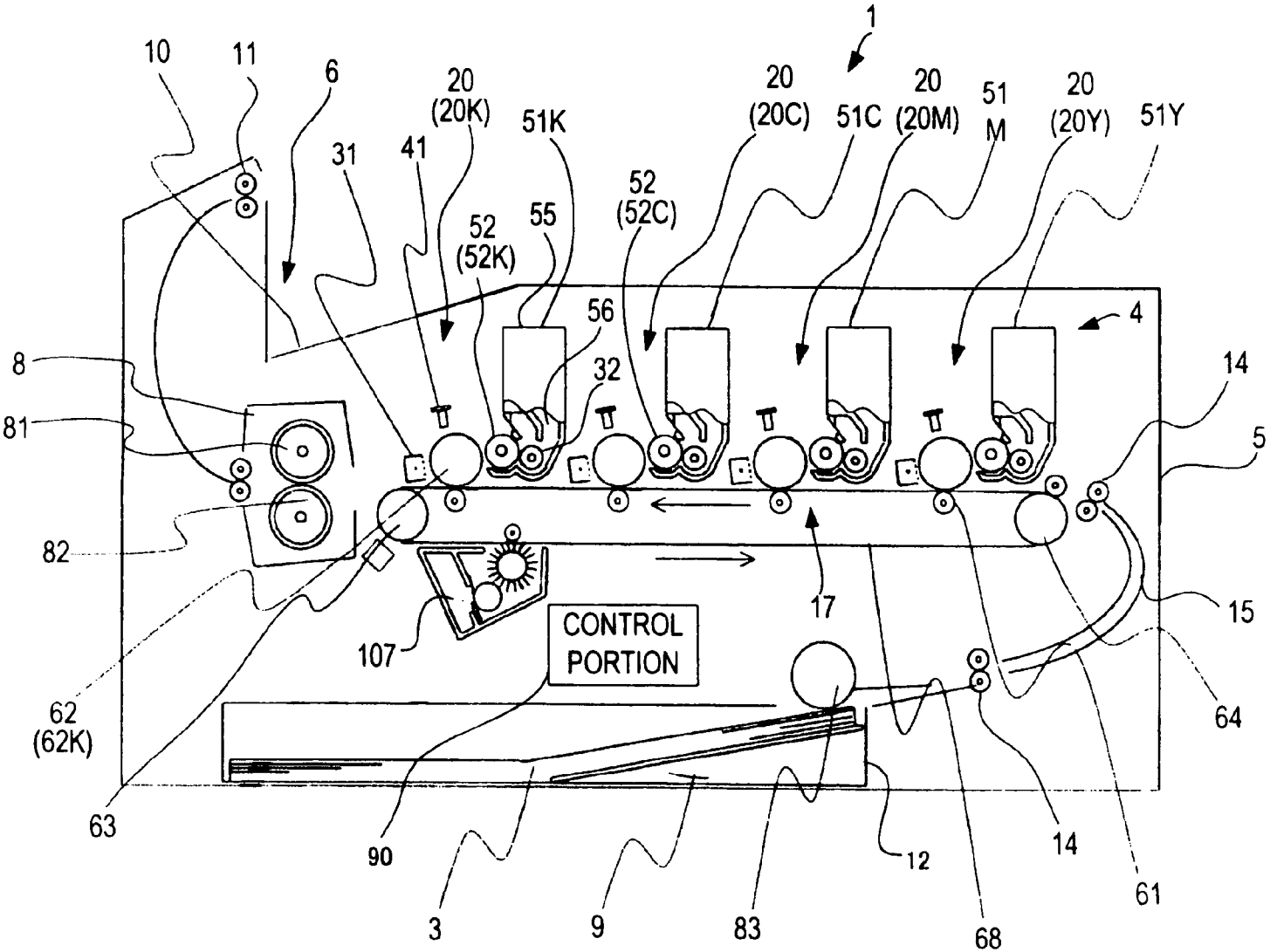
FIG. 1 is a diagrammatic cross-sectional view showing the overall structure of a direct tandem color laser printer of a first embodiment.

As shown in FIG. 1, a color laser printer 1 is a so-called horizontal type tandem color laser printer including the below-described four image forming units 20 arranged side by side in a horizontal direction. Hereinafter, the right side in FIG. 1 is referred to as the "front" side, while the left side is referred to as the "rear" side. The color laser printer 1 is provided, in a main body casing 5, with a paper supply portion 9 for supplying recording paper 3, an image forming portion 4 for forming an image on the supplied recording paper, a paper discharge portion 6 for discharging the recording paper 3 with the formed image thereon, and a control portion 90 for controlling the operation of the color laser printer 1.

The paper supply portion 9 at the bottom of the main body casing 5 is provided with a paper feed tray 12 detachably attached to the main body casing 5 from the front and a paper feed roller 83 disposed above one end portion (above a front end portion) of the paper feed tray 12. The paper supply portion 9 is also provided with conveyer rollers 14 which are disposed above the paper feed roller 83 and downstream from the paper feed roller 83 in the conveying direction of the recording paper 3.

The recording paper 3 is stacked on the paper feed tray 12, and uppermost sheets of the recording paper 3 are fed sheet by sheet to the conveyer roller 14 by rotation of the paper feed roller 83, and are conveyed sequentially from the conveyer rollers 14 to transfer positions between each of photoconductor drums 62 and a conveyer belt 68.

Guide members 15 are provided between the paper feed roller 83 and the conveyer rollers 14. The recording paper 3 fed by the paper feed roller 83 is conveyed sequentially to the transfer positions between each of the photoconductor drums 62 and the conveyer belt 68 through the guide members 15.

The image forming portion 4 is provided with four image forming units 20Y, 20M, 20C, and 20K that form images, a transfer portion 17 that transfers images formed by the image forming units 20 onto the recording paper 3, and a fixing portion 8 that heats and presses the transferred images on the recording paper 3 to fix the images on the recording paper 3.

Each of the image forming units 20 includes the photoconductor drum 62, as well as a charger 31 that charges the photoconductor drum 62, a scanner unit 41 that forms an electrostatic latent image on the photoconductor drum 62, and a developing unit 51 that forms a developing agent image by applying a developing agent to the photoconductor drum 62, all being arranged around the photoconductor drum 62.

The charger 31 is, for example, a scorotron charger for positive charging that generates a corona discharge from a charging wire made of tungsten or the like to uniformly and positively charge the surface of the photoconductor drum 62.

The scanner unit 41 includes a not-shown laser generator that generates a laser light to form an electrostatic latent image on the surface of the photoconductor drum 62, a not-shown lens, and others. The scanner unit 41 irradiates, in a scanning manner, the photoconductor drum 62 with a laser light emitted by a laser emitter to form an electrostatic latent image on the surface of the photoconductor drum 62.

The developing unit 51 disposed in an upper area of the main body casing 5 includes a development casing 56 that houses a developing agent hopper 56, a supply roller 32, and a developing roller 52.

The developing agent hopper 56 is defined as an interior space of the development casing 55. The developing agent hopper 56 of each of the image forming units 20 contains a developing agent for a color of yellow(Y), magenta(M), cyan(C), or black(K).

That is, the above-mentioned four image forming units 20 include the image forming unit 20Y with the developing agent hopper 56 containing a developing agent for yellow (Y), the image forming unit 20M with the developing agent hopper 56 containing a developing agent for magenta(M), the image forming unit 20C with the developing agent hopper 56 containing a developing agent for cyan(C), and the image forming unit 20K with the developing agent hopper 56 containing a developing agent for black(K).

The supply roller 32 disposed at a lower portion of the developing agent hopper 56 includes a metal roller shaft and a roller sleeve which is made of a conductive sponge and surrounds the metal roller shaft. The supply roller 32 is rotatably supported so as to rotate in a direction opposite to the direction of the developing roller 52 in facing contact with the developing roller 52.

The developing roller 52 is rotatably disposed so as to be in facing contact with the supply roller 32 downstream from the supply roller 32. The developing roller 52 includes a metal roller shaft and a roller sleeve which is made of an elastic member such as a conductive rubber material and surrounds the metal roller shaft.

The transfer portion 17 is provided in the main body casing 5 so as to face the photoconductor drums 62 under the developing units 51K, 51C, 51M, and 51Y. The transfer portion 17 includes a conveyer belt drive roller 63, a conveyer belt follower roller 64, the conveyer belt 68 which is an endless belt, and transfer rollers 61.

The conveyer belt follower roller 64 is disposed on the front side from the photoconductor drum 62 of the image forming unit 20Y for yellow which is located most upstream in the conveying direction of the recording paper 3, and over the paper feed roller 83. The conveyer belt drive roller 63 is disposed on the rear side from the photoconductor drum 62 of the image forming unit 20K for black which is located most downstream in the conveying direction of the recording paper 3, and on the front side from the fixing portion 8.

The conveyer belt 68 is wound between the conveyer belt drive roller 63 and the conveyer belt follower roller 64. The conveyer belt 68 is disposed such that the outer surface of the conveyer belt 68 is in facing contact with all of the photoconductors 62 of the image forming units 20.

When the conveyer belt drive roller 63 is driven, the conveyer belt follower roller 64 is caused to move. Then, the conveyer belt 68 rotates in a counterclockwise direction between the conveyer belt drive roller 63 and the conveyer belt follower roller 64, such that the conveyer belt 68 rotates in facing contact with the photoconductor drums 62.

The transfer rollers 61 are disposed on the inner side of the wound conveyer belt 68 such that the transfer rollers 61 face the photoconductor drums 62 of the image forming units 20 with the conveyer belt 68 located therebetween. Each of the transfer rollers 61 includes a metal roller shaft and a roller sleeve which is made of an elastic member such as a conductive rubber material and surrounds the metal roller shaft.

The transfer rollers 61 are disposed so as to be rotatable in a counterclockwise direction, 80 that the transfer rollers 61 rotate in facing contact with the conveyer belt 68. At the time of transfer, a specific voltage is applied by a not-shown power source, and thereby an appropriate transfer bias is applied between the transfer rollers 61 and the photoconductor drums 62 by constant current control in a direction in which the developing agent images carried on the photoconductor drums 62 are transferred onto the recording paper 3.

The fixing portion 8 is disposed at the rear of and downstream from the image forming units 20 and the transfer portion 17 in the conveying direction. The fixing portion 8 includes a heating roller 81 and a pressure roller 82. The heating roller 81 includes a metal pipe having a surface on which a seizure preventing layer is formed and housing a halogen lamp along the axial direction thereof. The surface of the heating roller 81 is heated with the halogen lamp to a fixing temperature. The pressure roller 82 is disposed so as to press the heating roller 81.

The paper discharge portion 6 is disposed in the upper portion of the main body casing 5 and downstream from the fixing portion 8 in the conveying direction. The paper discharge portion 6 includes a pair of paper discharge rollers that discharge the recording paper 3 after the fixing of the image is completed and a paper exit tray 10 that collects the recording paper 3 on which an image has been formed.

Figure 2:
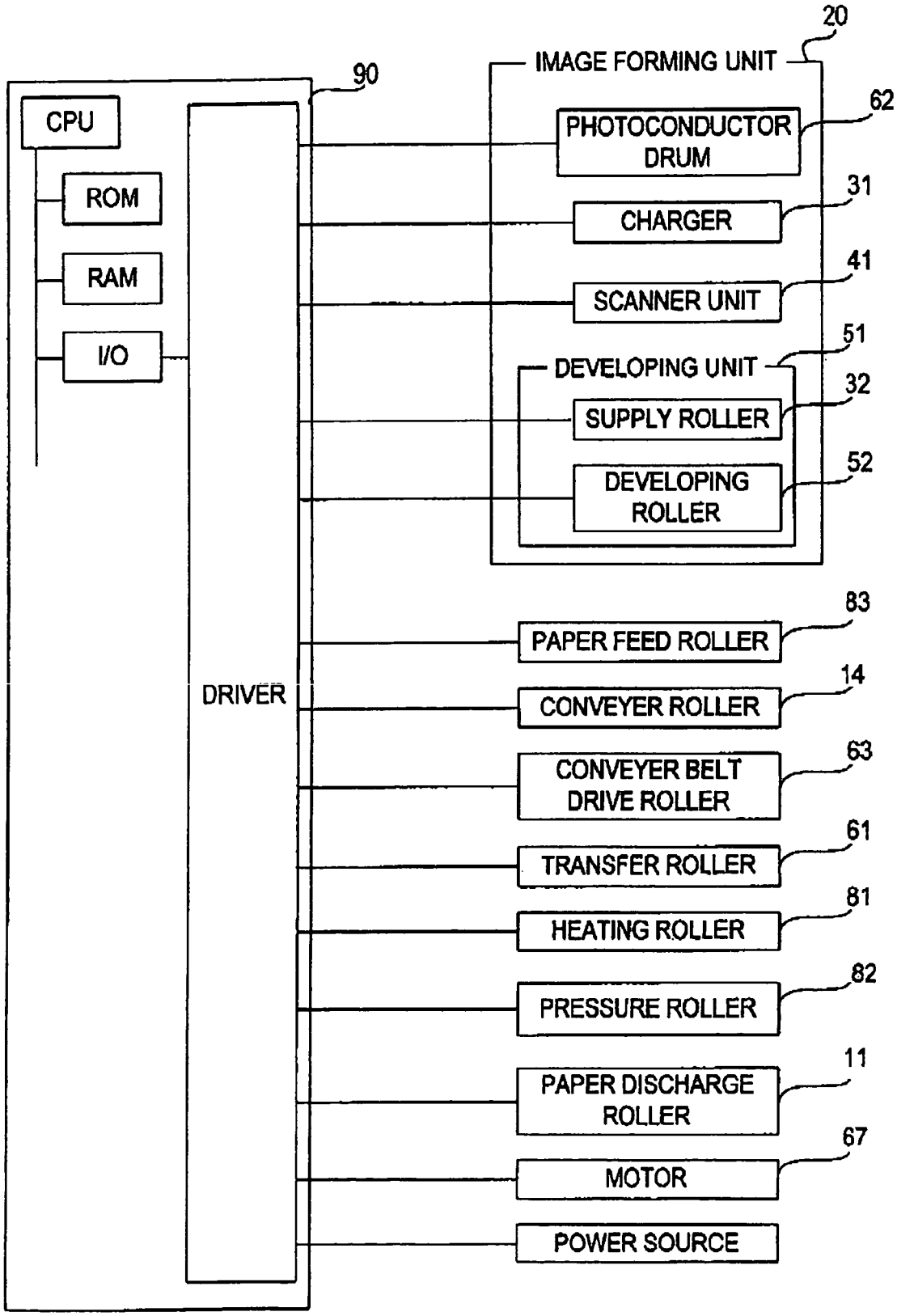
FIG. 2 is a block diagram schematically showing the electric structure of the color laser printer.

With reference to FIG. 2, a description will now be made about the electric structure of the color laser printer 1 and the process of forming a color image on the recording paper 3 by the color laser printer 1 through the cooperative operation of the above described various components of the color laser printer 1.

As shown in FIG. 2, the color laser printer 1 is provided with a control portion 90 (a CPU, a ROM, a RAM, an 110, a driver, and others are installed therein.) The control portion 90 controls the various components of the color laser printer 1 to perform ordinary image forming operation, estimation of reversely transferred developing agent amount, and reversely transferred developing agent removal operation.

In ordinary image forming operation, the control portion 90 of the color laser printer 1 first performs initialization of the various components to be controlled during imago formation by main control processing section (program). Then, the control portion 90 makes the charger 31 uniformly charge the surface of the photoconductor drum 62, and makes the scanner unit 41 irradiate a laser light modulated according to image information to form an electrostatic latent image on the surface of the photoconductor drum 62. Subsequently, the control portion 90 makes the developing unit 51 apply a developing agent to the surface of the photoconductor drum 62 to visualize the electrostatic latent image on the surface of the photoconductor drum 62. Then, the control portion 90 rotates the photoconductor drum 62 to move a visual image (a developing agent image) visualized as above to a transfer position.

The control portion 90 actuates the paper feed roller 83 and the conveyer roller 14 to supply the recording paper 3 onto the conveyer belt 68. The control portion 90 also actuates the conveyer belt drive roller 63 to thereby rotate the conveyer belt 68 and supply the recording paper 3 to the transfer position. At the transfer position, the control portion 90 makes a transfer bias voltage applied between the transfer roller 61 and the photoconductor drum 62 to transfer the visual image onto the recording paper 3.

Next, the control portion 90 rotates the conveyer belt 68 to convey the recording paper 3 to the fixing portion 8. In the fixing portion 8, the control portion 90 makes the heating roller 81 and the pressure roller 82 heat and press the visual image (the developing agent image) on the recording paper 3 while conveying the recording paper 3 in a sandwiching manner so as to fix the visual image on the recording paper 3. Then, the control portion 90 actuates the paper discharge roller 11 to discharge the recording paper 3 onto the paper exit tray 10 in the upper portion of the main body casing 5, and terminates the image forming operation.

Then, the control portion 90 makes the developing unit 51 collect developing agent remaining on the photoconductor drum 62 after the transfer of the visual image onto the recording paper 3 at the transfer portion 17, in order to reuse the collected developing agent at the next development.

Specifically, the photoconductor drum 62 to which the developing agent (the remaining developing agent after transfer) that has not been transferred at the transfer portion 17 is rotated, and the photoconductor drum 62 is charged at a charging position where the photoconductor drum 62 faces the scorotron charger 31. Then, the remaining developing agent after transfer can be collected by the developing roller 52 with a developing bias applied in a direction of sucking the remaining developing agent after transfer when facing the developing roller 52.

When the visual image is transferred onto the recording paper 3 at the second or later image forming unit 20 from the upstream, i.e. the image forming unit 20(M), 20(C), or 20(K), developing agent transferred onto the recording paper 3 at the developing units 51 upstream from the present image forming unit 20 may be reversely transferred onto the photoconductor drum 62 of the present image forming unit 20. Then, in turn, the developing agent reversely transferred onto the photoconductor drum 62 may be collected by the developing roller 52 contacting the photoconductor drum 62. This is considered to occur since the developing agent of the visual image already transferred onto the recording paper 3 is charged to opposite polarity to the original charging polarity due to some reason.

Part of the developing agent reversely transferred onto the developing roller 52, which is not collected into the developing agent hopper 56, is attached to the photoconductor drum 62 at the next image formation, and thereby is transferred onto the recording paper 3. As a result, a developing agent image of a color to be formed at the present imago forming unit 20 is mixed with a developing agent of a different color in another (i.e. an upstream) image forming unit 20, which leads to a deteriorated image quality.

If the amount of the reversely transferred developing agent is small, deterioration of image quality due to color mixture may not be conspicuous. However, if the cumulative number of prints is increased, and the amount of the reversely transferred developing agent attached to the surface of the developing roller 52 is accordingly increased, deterioration of image quality due to color mixture will be a significant problem.

In such a case, the control portion 90 prevents color mixture by removing the reversely transferred developing agent through so-called solid printing. In solid printing, the control portion 90 makes the charger 31 charge the photoconductor drum 62, and then makes the scanner unit 41 expose the entire surface of the photoconductor drum 62 to form an image and perform full surface printing on the recording paper 3.

Specifically, the control portion 90 makes the charger 31 charge the photoconductor drum 62, and then makes the scanner unit 41 operate in a scanning manner to expose the photoconductor drum 62 in the width direction at least over a length corresponding to the circumference of the developing roller 52. Subsequently, a developing agent is applied to the entire surface of the photoconductor drum 62 with the developing roller 52. Then, the reversely transferred developing agent attached to the surface of the developing roller 52 is simultaneously applied to the photoconductor drum 62. Accordingly, it is possible to remove the reversely transferred developing agent attached to the surface of the developing roller 52 by transferring the developing agent applied to the entire surface of the photoconductor drum 62 onto the recording paper 3.

If the reversely transferred developing agent is removed by the above mentioned solid printing at each time of original printing, consumption of the recording paper 3 and the developing agent will be increased. In addition, the lifetimes of the photoconductor drum 62 and the developing roller 52 may be shortened. To avoid such problems, the control portion 90 estimates the amount of the reversely transferred developing agent attached to the developing roller 52, and performs solid printing when the estimated amount exceeds a predetermined value.

The amount of the reversely transferred developing agent which is reversely transferred at one of the four image forming units 20 of the color laser printer 1 is proportional to the surface area of images formed at the image forming units 20 upstream from the one of the four image forming units 20 during each printing. The adherence of the reversely transferred developing agent to the developing roller 52 depends on the difference between the charging capacity of the developing agent of the one of the four image forming units 20 and the charging capacity of the reversely transferred developing agent.

For example, to the developing roller 62C of the image forming unit 20C for the color of cyan(C), developing agents for two colors of yellow(Y) and magenta(M) used for image formation at the upstream image forming units 20Y and 20M are attached and accumulated as the reversely transferred developing agent.

The amount of the reversely transferred developing agent accumulated at the image forming unit 20C during each printing is in proportion to the surface area of images in yellow(T) and magenta(M) formed at the two upstream image forming units 20Y and 20M, respectively. The amount of the reversely transferred developing agent attenuates according to the operating time of the developing roller 62K of the image forming unit 20K, with the difference between the charging capacity of the developing agent for yellow(Y) and the charging capacity of the developing agent for cyan(C) as a factor of the time constant, and also with the difference between the charging capacity of the developing agent for cyan(C) and the charging capacity of the developing agent for magenta (M) as a factor of the time constant.

Accordingly, the control portion 90 estimates the amount of the reversely transferred developing agent at one of the four image forming units 20 by multiplying the amount of the reversely transferred developing agent during each printing estimated as described above by the number of printing. However, it is preferable to perform calculation about a practically reasonable number, for example, up to printing of 100 sheets, since calculation about all the previous printing requires a large amount of time.

The above method of estimation is indicated by the following formulas.

Amount of reversely transferred developing agent on $$\text{magenta}(M)\ \text{developing roller} = \sum_{l=1}^{N}\{I_{Yl}P_{YM}\exp[-\alpha\cdot t_l/(Q_Y-Q_M)]\}$$

Amount of reversely transferred developing agent on $$\text{cyan}(C)\ \text{developing roller} = \sum_{l=1}^{N}\{I_{Yl}P_{YC}\exp[-\alpha\cdot t_l/(Q_Y-Q_C)]+(I_{Ml}P_{MC})\exp[-\alpha\cdot t_l/(Q_M-Q_C)]\}$$

Amount of reversely transferred developing agent on $$\text{black}(\overline{K})\ \text{developing roller} = \sum_{l=1}^{N}\{I_{Yl}P_{YK}\exp[-\alpha\cdot t_l/(Q_Y-Q_K)]+(I_{Ml}P_{MK})\exp[-\alpha\cdot t_l/(Q_M-Q_K)]+(I_{Cl}P_{CK})\exp[-\alpha\cdot t_l/(Q_C-Q_K)]\}$$

N: total number of prints, l: number of prints, I: surface area of image, P: rate of reverse transfer, t: operating time from the start of printing, Q: charging amount (charging capacity), α: attenuation coefficient.

The subscripts Y, M, C and K indicate yellow, magenta, cyan, and black, respectively. The two subscripts to the rate of reverse transfer P indicate the rate of reverse transfer P in the case where an image having a color component of the left subscript is reversely transferred to the photoconductor drum 62 for the color of the right subscript. For example, $P_{YM}$ indicates the rate of reverse transfer of yellow(Y) to the photoconductor drum 62 for magenta(M), while $P_{YC}$ indicates the rate of reverse transfer of yellow(Y) to the photoconductor drum 62 for cyan(C).

To calculate the amount of the reversely transferred developing agent for a given number of prints, the amounts of the reversely transferred developing agent obtained at respective times of printing are stored on the RAM as a history. For example, to calculate the amount of the reversely transferred developing agent for ten prints (N=10), addition of the amounts of the reversely transferred developing agent at respective times of printing of previous ten prints is performed. Old data not subjected to the calculation is sequentially deleted.

The charging amount, which is estimated depending on the value of a bias voltage applied between the photoconductor drum 62 and the developing roller 52, is used herein as an indication of the charging capacity of the developing agent of each of the image forming units 20. However, if modification such as multiplying the charging amount by an appropriate coefficient or adding or subtracting a value to or from the charging amount leads to a better result, the charging capacity obtained by the modification should be used for calculation.

Specifically, in the color laser printer 1, printing of a specific color pattern is performed at predetermined intervals to prevent deterioration of image quality due to aged deterioration of the components or the developing agents of the image forming units 20, and color proofing is performed based on the result of the printing. Then, the above-mentioned bias voltage is adjusted based on the result of the color proofing. The control portion 90 estimates the charging amount of the developing agent based on the adjusted bias voltage, and appropriately modify the charging amount, if necessary, to obtain the charging capacity.

The above method of estimation is not limited to the above indicated formulas. For example, by separating secondary colors (R, G, and B) and tertiary colors (mixture of three colors R. G, and B, hereinafter indicated by "H" in the following formulas), a more accurate estimation can be performed. In this case, estimation is performed on the assumption that the closer to the photoconductor drum 62 the layer of the developing agent is, the easier reverse transfer of secondary colors and tertiary colors occurs.

Amount of reversely transferred developing agent on $$\text{magenta}(M)\ \text{developing roller} = \sum_{I=1}^{N}\{I_{YI}P_{YM}\exp[-\alpha\cdot t_I/(Q_Y-Q_M)]\}$$

Amount of reversely transferred developing agent on $$\text{cyan}(C)\ \text{developing roller} = \sum_{I=1}^{N}\{(I_{YI}P_{YC})\exp[-\alpha\cdot t_I/(Q_Y-Q_C)] + (I_{MI}P_{MC})\exp[-\alpha\cdot t_1/(Q_M-Q_c)] + (I_{RI}P_{RC})\exp[-\alpha\cdot t_I/(Q_M-Q_C)]\}$$

Amount of reversely transferred developing agent on $$\text{black}(K)\ \text{developing roller} = \sum_{I=1}^{N}\{(I_{YI}P_{YK})\exp[-\alpha\cdot t_I/(Q_Y-Q_C)] + (I_{MI}P_{MK})\exp[-\alpha\cdot t_1/(Q_M-Q_K)] + (I_{CI}P_{CK})\exp[-\alpha\cdot t_I/(Q_C-Q_K)] + (I_{RI}P_{RK})\exp[-\alpha\cdot t_I/(Q_M-Q_K)] + (I_{GI}P_{GK})\exp[-\alpha\cdot t_I/(Q_C-Q_K)] + (I_{BI}P_{BK})\exp[-\alpha\cdot t_I/(Q_C-Q_K)] + (I_{HI}P_{HK})\exp[-\alpha\cdot t_I/(Q_C-Q_K)]\}$$

Next, sequential processings of estimation of the amount of reversely transferred developing agent and of removal of reversely transferred developing agent are described with reference to FIGS. 3, 4 and 5.

The control portion 90 starts the processing of estimation of the amount of reversely transferred developing agent in S110, for example, when an ordinary image forming operation of the color laser printer 1 is terminated (alternatively, when the operation is started).

Figure 4:
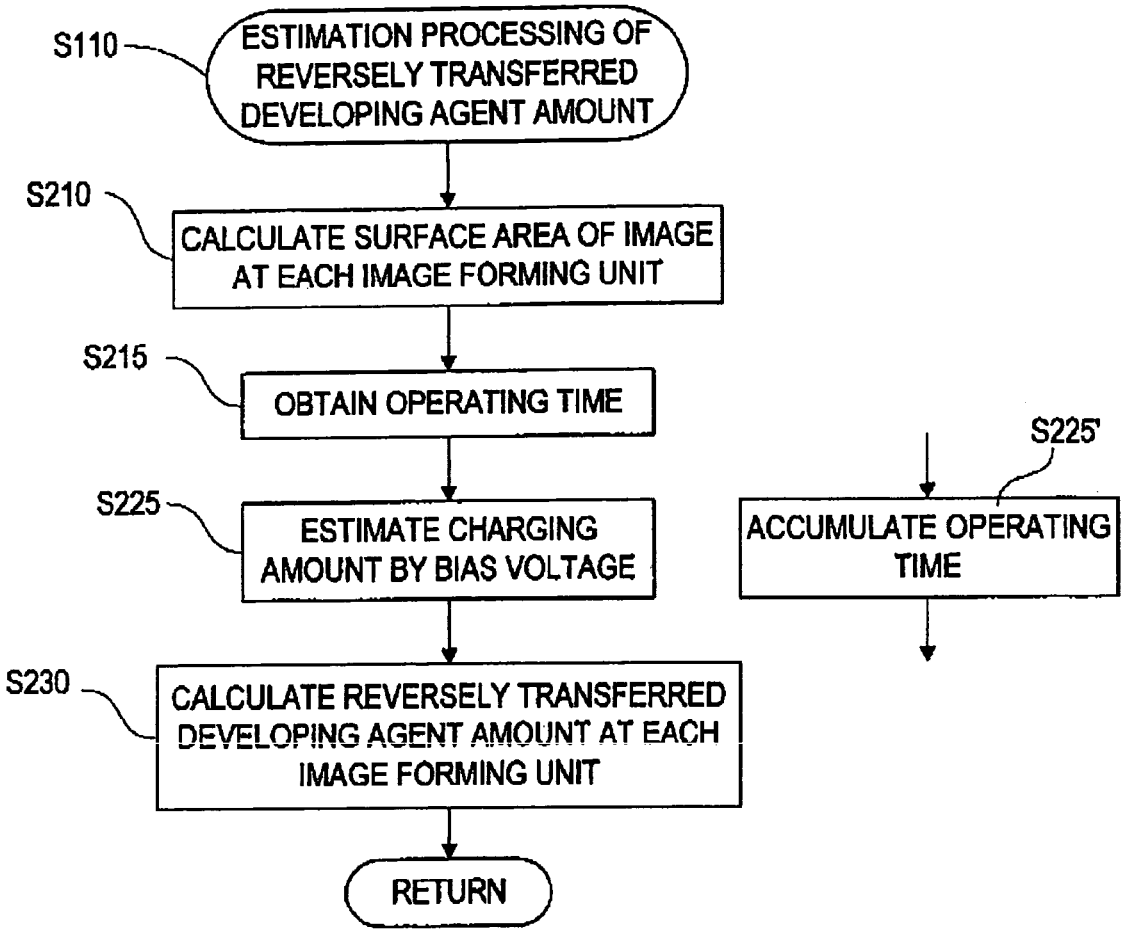
FIG. 4 is a flowchart of a reversely transferred developing agent amount estimation processing as a subroutine called from the main processing in FIG. 3.

In the processing of estimation of the amount of reversely transferred developing agent in S110, the processing is shifted to the subroutine shown in FIG. 4. First, in S210, data of a color image to be formed with the present color laser printer 1 is divided into data of colors of yellow(Y), magenta (M), cyan(C), and black(K), and the surface areas of images to be formed with the image forming units 20Y, 20M, 20C, and 20K are calculated based on the divided data of the respective colors. Then the processing proceeds to S215.

In S215, the operating time of the image forming units 20 (data stored on the RAM) after formation of images is obtained, and the processing proceeds to S225.

In S225, the charging amount (charging capacity) of the developing agent in each of the image forming units 20 is estimated based on the bias voltage applied to the photoconductor drum 62 and the developing roller 52 of each of the image forming units 20, and then the processing proceeds to S230.

In S230, the amount of reversely transferred developing agent in each of the image forming units 20 is estimated based on the data obtained in S210 through S225 according to the above formulas for estimation of the amount of reversely transferred developing agent. Then, the processing returns from the subroutine and proceeds to S115.

In S115, it is determined whether or not the estimated amount of the reversely transferred developing agent exceeds a predetermined value. When it is determined that the amount of the reversely transferred developing agent exceeds the predetermined value ("Yes" in S115), the processing proceeds to S120. When it is determined that the amount of the reversely transferred developing agent does not exceed the predetermined value ("No" in S115), the processing is terminated instead of proceeding to S120.

Figure 5:
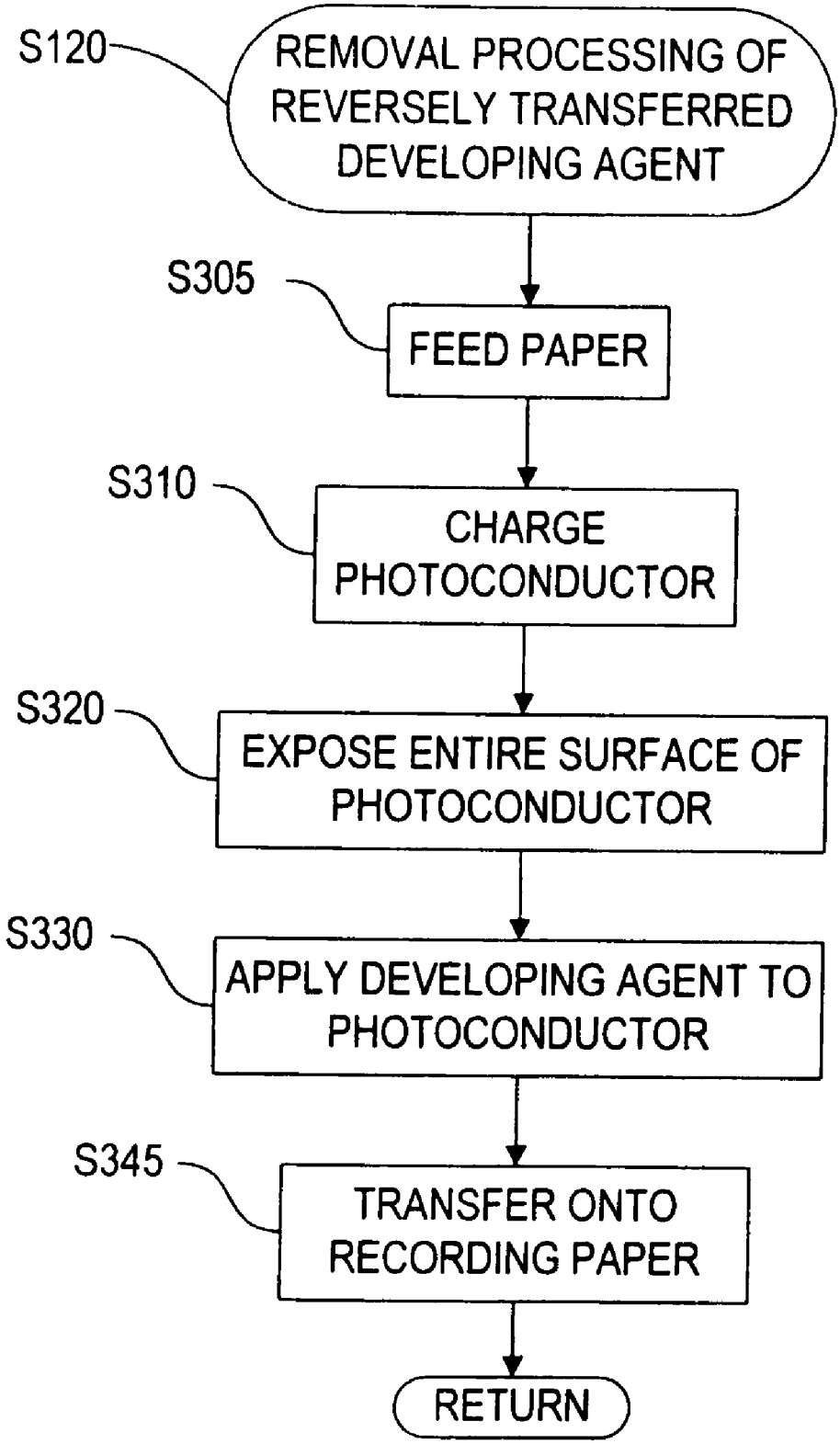
FIG. 5 is a flowchart of a first reversely transferred developing agent removal processing as a subroutine called from the main processing in FIG. 3.

During the processing of removal of reversely transferred developing agent in S120, the processing is shifted to the subroutine shown in FIG. 5. First, in S305, the recording paper 3 is supplied by rotating the paper feed roller 83. Then, the charger 81 is actuated to charge the photoconductor drum 62, and then the processing proceeds to S320.

In S320, the scanner unit 41 is actuated to expose the entire surface of the photoconductor drum 62 in a scanning manner, and then the processing proceeds to S330.

In S330, the developing roller 52 is actuated to apply the developing agent stored in the developing agent hopper 56 to the photoconductor drum 62 whose entire surface has been exposed. By this operation, the reversely transferred developing agent attached to the surface of the developing roller 52 is applied to the photoconductor drum 62 along with the developing agent supplied from the developing agent hopper 56. Then, the processing proceeds.

In S345, a developing agent image (a so-called solid image) on the surface of the photoconductor drum 62 whose entire surface has been developed is transferred onto the recording paper 3, and the processing returns from the subroutine and then is terminated.

As described above, according to the color laser printer 1 of the first embodiment, the reversely transferred developing agent attached to the surface of the developing roller 52 is removed by solid printing on the recording paper 3. Therefore, it is possible to prevent color mixture by the reversely transferred developing agent, thereby to prevent image deterioration at the time of printing.

According to the color laser printer 1 of the first embodiment, the amount of the reversely transferred developing agent attached to the developing roller 52 is estimated and sold printing is performed only when the estimated amount exceeds a predetermined value. Therefore, it is possible to prolong the lifetimes of the photoconductor drum 62 and the developing roller 52 as well as to reduce the consumption of the recording paper 3 and the developing agent.

When the use of the color laser printer 1 is continued, the charging capacity, and thus the charging amount, of the developing agent is decreased as the operating time of the developing roller 52 is increased. Accordingly, it is possible for the control portion 90 to estimate the charging amount based on the operating time.

This processing may be performed by replacing the estimation of the charging amount by a bias voltage in S225 in the processing of estimation of the amount of reversely transferred developing agent in S100 in FIG. 4 with accumulation of the operating time in S225 of the image forming unit 20 obtained in S215. The estimation of the charging capacity of the developing agent as described above facilitates easier processing at the control portion 90.

Alternatively, the estimation of the amount of the reversely transferred developing agent at the control portion 90 may be performed by using, as a parameter, the amount of the developing agent per pixel at the time of image formation instead of the surface area of images.

Specifically, the amount of the reversely transferred developing agent attached to one of the four image forming units 20 is estimated at the control portion 90 as described below. First, the amount of the developing agent per pixel of the images formed at the image forming units 20 upstream from the one of the four image forming units 20 is calculated based on the image data. Subsequently, the amount of reversely transferred developing agent per printing operation is estimated by multiplying the calculated amount of the developing agent by the number of pixels formed. Then, the amount of reversely transferred developing agent attached to the one of the four image forming units 20 is estimated by multiplying the reversely transferred developing agent per printing operation estimated according to the above estimation method by the number of printing operations.

An example of formulas to obtain the amount of reversely transferred developing agent on the photoconductor drum 62K for black(K) according to the above estimation method is as follows.

Amount of reversely transferred developing agent of yellow (y)=0

Amount of reversely transferred developing agent of $$\text{magenta}(M) = \sum_{l=1}^{N}\sum_{m}^{S}\left[M_Y M_M * \{3*M_Y + 2*(1-M_Y)*M_M + (1-M_Y)*(1-M_Y)*M_C\}\right]$$

Amount of reversely transferred developing agent of $$\text{cyan}(M) = \sum_{l=1}^{N}\sum_{m}^{S}\{(M_Y + M_M)*M_C * \{3*M_Y + 2*(1-M_Y)*M_M + (1-M_Y)*(1-M_M)*M_C\}\}$$

M: amount of developing agent per pixel, N: total number of prints, l: number of prints, S: total number of pixels, m: number of pixels.

Subscripts: Y: yellow, M: magenta, C: cyan, K: black.

In the above formulas, the amount of reversely transferred developing agent of magenta(M) equals to the summation of $I_M \times P_{MK}$ and $I_R \times P_{RK}$. This indicates that a value obtained by multiplying the surface area of an image in magenta(M) $I_M$ by the rate of reverse transfer of magenta(M) against the black(K) photoconductor drum 62K $P_{MK}$ is added to a value obtained by multiplying the surface area of an image in red(R) $I_R$ by the rate of reverse transfer of red(R) against the black(K) photoconductor drum 62K $P_{RK}$.

The amount of reversely transferred developing agent of cyan(C) equals to the summation of $I_C \times P_{CK}$, $I_G \times P_{GK}$, and $I_B \times P_{BK}$. This indicates that a value obtained by multiplying the surface area of an image in cyan(C) $I_C$ by the rate of reverse transfer of cyan(C) against the black(K) photoconductor drum 62K $P_{CK}$, a value obtained by multiplying the surface area of an image in green(G) $I_G$ by the rate of reverse transfer of green(G) against the black(K) photoconductor drum 62K $P_{CK}$ are added to a value obtained by multiplying the surface area of an image in blue(B) $I_B$ by the rate of reverse transfer of blue(B) against the black (K) photoconductor drum 62K $P_{BK}$.

It is possible to calculate the amount of reversely transferred developing agent on the developing roller 52 based on the amount of reversely transferred developing agent on the photoconductor drum 62 obtained according to the above formulas and by considering the difference in charging amount (charging capacity) of developing agents and the operating time in the same manner as in the previously indicated formulas.

In this processing, the amount of the developing agent forming a unit pixel is calculated in S210 in the processing of estimation of the amount of reversely transferred developing agent in S110 in the flowchart of FIG. 4. Then, the amount of the reversely transferred developing agent at each of the image forming units 20 is estimated according to the above formulas.

In terms of a secondary scanning direction (or a longitudinal direction or the conveying direction of recording paper), the reversely transferred developing agent attaches to a specific position in the axial direction of the developing roller 52. It is, therefore, further preferable to estimate the amount of the reversely transferred developing agent in the secondary scanning direction and perform solid-printing of only an area in which the amount of the reversely transferred developing agent exceeds a predetermined value in order to clean the area.

When so-called solid printing is performed on the recording paper 3, the consumption of the recording paper 3 is increased. To avoid such an increase, solid printing is performed not on the recording paper 3 but on the conveyer belt 68 in a modified embodiment.

In this case, it is necessary to prevent the developing agent attached to the surface of the conveyer belt 68 from spoiling the recording paper 3 at the next image formation. Accordingly, the developing agent attached to the surface of the conveyer belt 68 is collected by a conveyer belt developing agent collection device 107. Then, the developing agent attached to the surface of the conveyer belt 68 will not spoil the recording paper 3.

The processing of removal of reversely transferred developing agent will now be described with reference to FIG. 6, which shows a flowchart of the processing of removal of reversely transferred developing agent as a subroutine called from FIG. 8.

Figure 3:
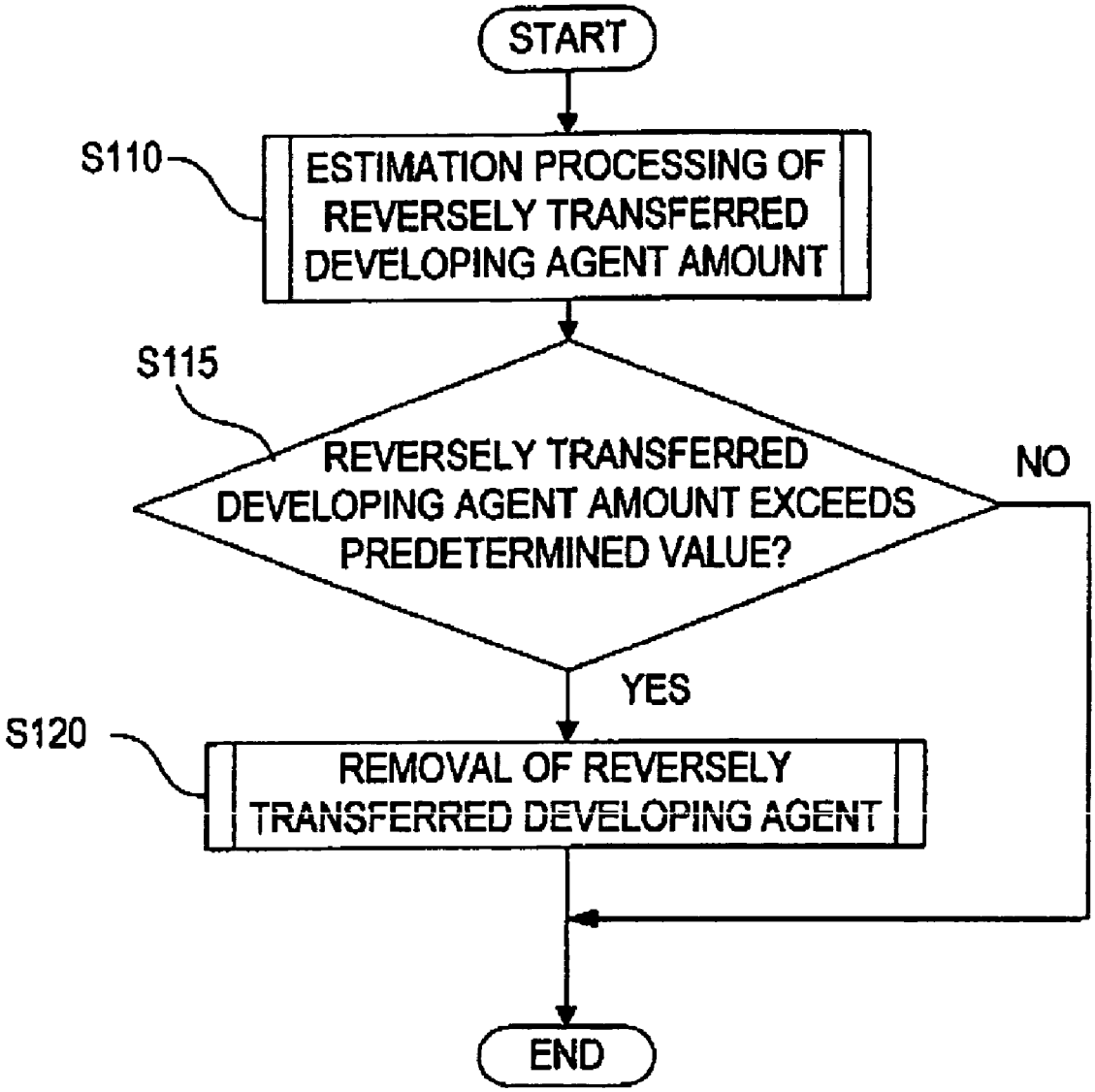
FIG. 3 is a flowchart of a main processing performed by a control portion.

The main flow shown in FIG. 3 will not be described here since it is the same as in the case of removal of reversely transferred developing agent by transfer onto the recording paper 3.

Figure 6:
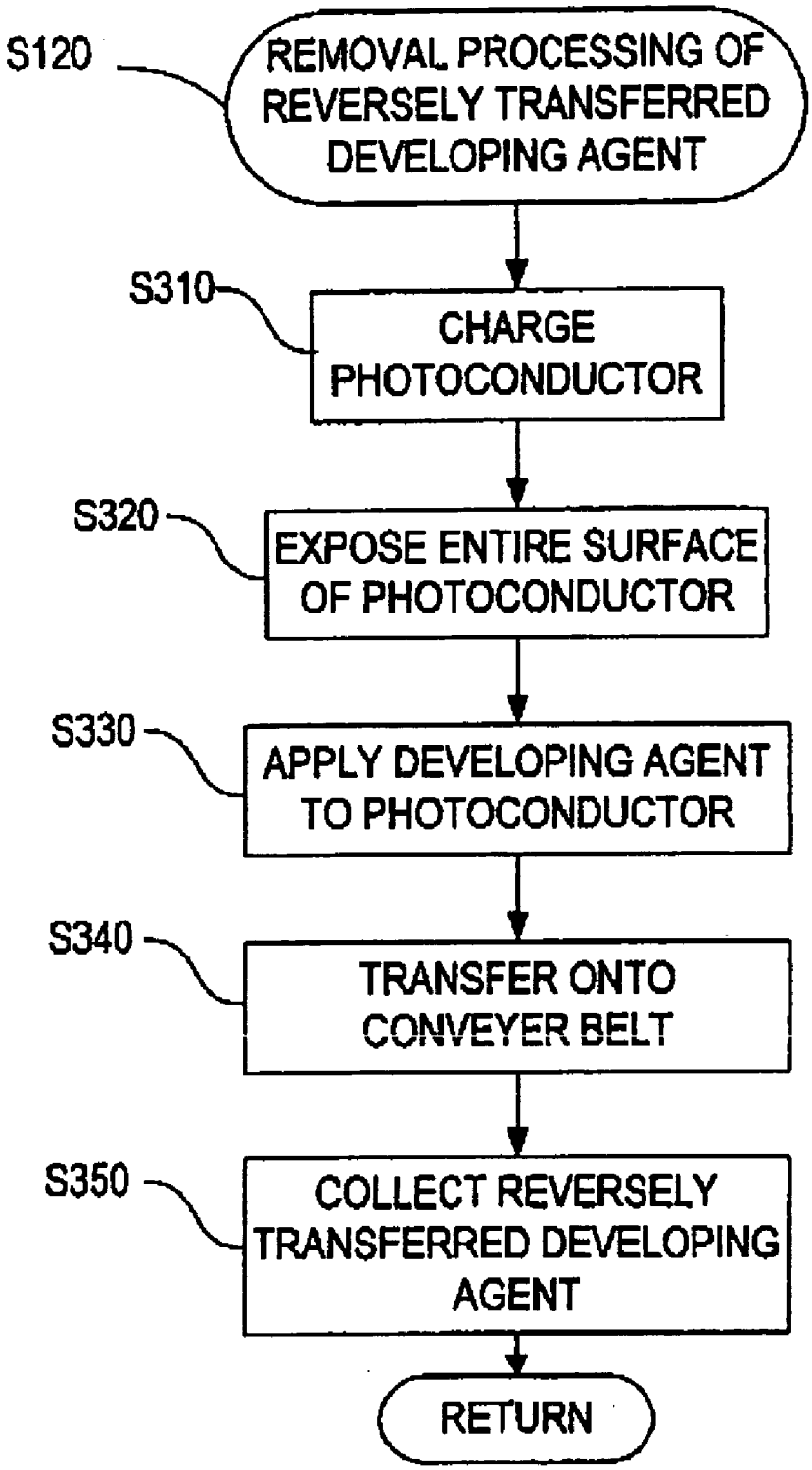
FIG. 6 is a flowchart of a second reversely transferred developing agent removal processing as a subroutine called from the main processing in FIG. 3.

In the processing of removal of reversely transferred developing agent shown in FIG. 6, the processing proceeds to S310 without supplying the recording paper 3.

In S310 through S330, the developing agent is applied to the entire surface of the photoconductor drum 62 in the same manner as in the case of removal of the reversely transferred developing agent by transfer onto the recording paper 3, and the processing proceeds to S340.

In S340, a developing agent image (a so-called solid image) on the surface of the photoconductor drum 62 whose entire surface has been developed is transferred onto the conveyer belt 68, and the processing proceeds to S350.

In S350, the developing agent transferred onto the conveyer belt 68 is collected by the conveyer belt developing agent collection device 107, and the processing returns from the subroutine and then is terminated.

According to the present modification as described above, consumption of the recording paper 3 for solid printing is unnecessary since solid printing is performed on the conveyer belt 68, which results in a reduction in total consumption of the recording paper 3 compared with the first embodiment.

The range of entire surface exposure of the photoconductor 62 in a circumferential direction for solid printing is at least the circumferential length of the developing roller 52, and may be twice or more the circumferential length. However, it is desirable to minimize the range considering that the consumption of the developing agent is increased as the range of solid printing is broadened.

In the processing of removal of reversely transferred developing agent described above, solid printing is performed on the recording paper 3 or the conveyer belt 68 to remove the reversely transferred developing agent. In this case, it is required to provide the transfer portions of the downstream image forming units 20 with electric fields that apply forces to the developing agent from the photoconductor drums 62 toward the recording paper 3 or the conveyer belt 68.

In the case of removing the reversely transferred developing agent while separating the photoconductor drums 62 with respect to which solid printing is not performed from the conveyer belt 68, it is unnecessary to provide such electric fields.

Figure 7:
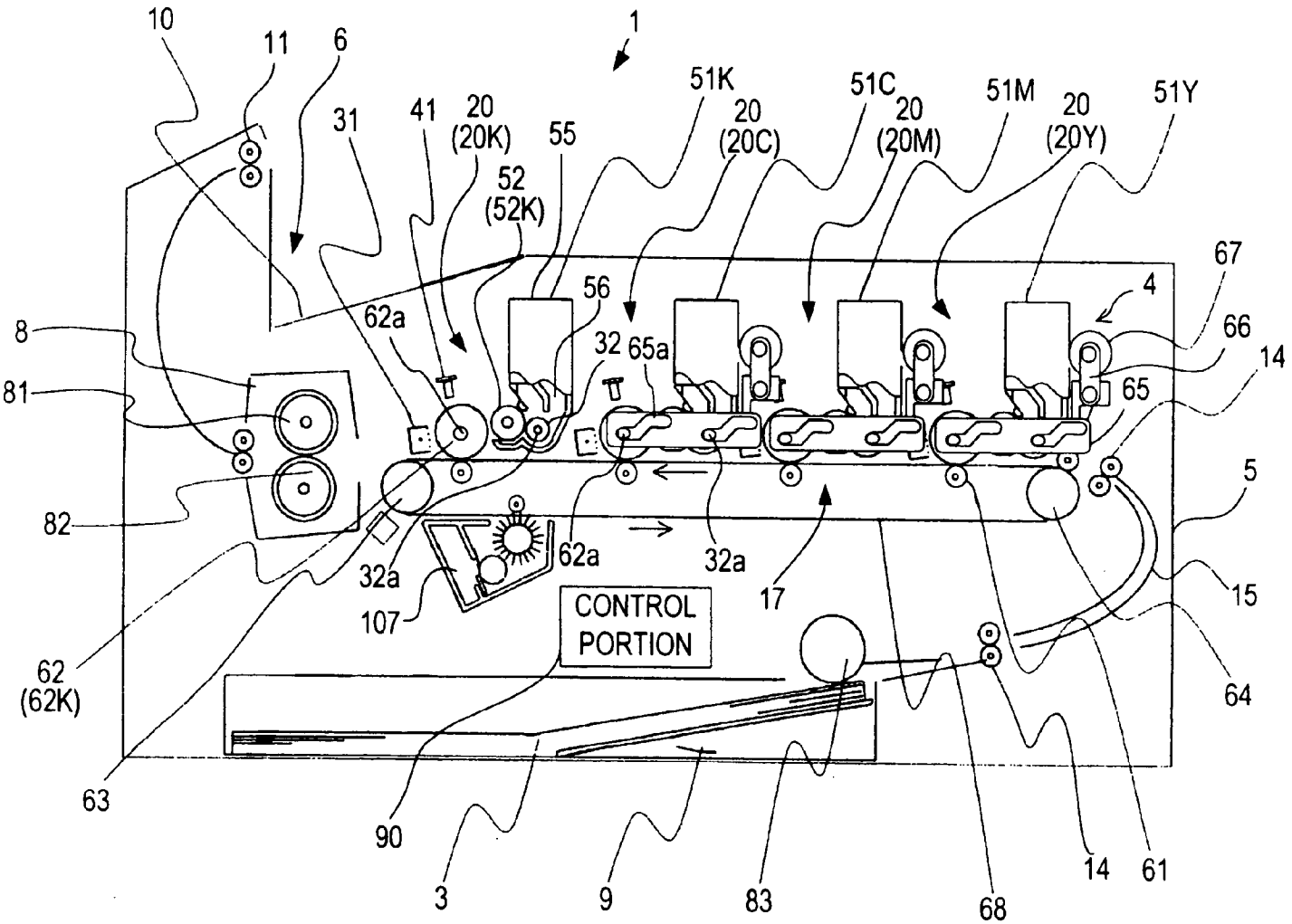
FIG. 7 is a diagrammatic cross-sectional view showing the overall structure of a color laser printer including a mechanism that separates a photoconductor drum from a conveyer belt.

Specifically, as shown in FIG. 7, the four image forming units 20Y, 20M, 20C, and 20K are supported to be movable in upper and lower directions such that the photoconductor drums 62 may be separated from the conveyer belt 68. The photoconductor drums 62 are selectively separated from the conveyer belt 68 by pairs of motion members 65, each pair being provided to each of the image forming units 20Y, 20M, 20C, and 20K. Only one of each pair of motion members 65 is shown in FIG. 7 and will be described below for simplification purposes.

The motion member 65 is supported by a not-shown guide mechanism so as to be movable in right and left directions along the moving direction of the conveyer belt 68. The motion member 65 is provided with two guide holes 65*a* each having a substantially crank-like shape including a horizontal groove along the moving direction of the motion member 65. A shaft 62*a* of the photoconductor drum 62 and a shaft 32*a* of the supply roller 32 of each of the image forming units 20Y, 20M, 20C, and 20K are fitted into respective guide holes 65*a*.

A link 66 is rotatably attached to a right end portion (in the figure) of the motion member 65 perpendicular to and upward from the motion member 65. A motor (or a rotating solenoid) 67 is provided to an end of the link 66. The rotating force of the motor 67 is transmitted to the motion member 65 through the link 68 so as to move the rotation member 65 in right and left directions.

The control portion 90 is designed to output instruction signals to control the rotating direction of the motor 67, and the motion member 65 is moved in right and left directions in accordance with the instruction signals from the control portion 90.

When the motion member 65 is moved in a left direction in accordance with an instruction by the control portion 90, the guide hole 65*a* is shifted in a right direction. Then, the shaft 62*a* of each of the image forming units 20Y, 20M, 20C, and 20K is moved upward along the substantially crank-like shape of the guide hole 65*a*, the photoconductor drum 62 is separated from the conveyer belt 68. In contrast, when the motion member 65 is moved in a right direction, the photoconductor drum 62 is brought into contact with the conveyer belt 68.

The photoconductor drum 62, the charger 31, the scanner unit 41, and the developing unit 51, which are integrally formed in the each of the image forming units 20Y, 20M, 20C, and 20K, are moved upward or downward all together.

According to such a mechanism, when the amount of the reversely transferred developing agent exceeds a predetermined value at one image forming unit 20 of the four image forming units 20Y, 20M, 20C, and 20K, the one image forming unit 20 is maintained in a normal condition in which the photoconductor drum 62 abuts the conveyer belt 68. At least at each of the image forming units 20 downstream from the one image forming unit 20, the photoconductor drum 62 can be separated from the conveyer belt 68 by rotationally driving the motor 67. When solid printing is performed in this state at the one image forming unit 20, at which the amount of the reversely transferred developing agent exceeds the predetermined value, the reversely transferred developing agent transferred onto the recording paper 3 or the conveyer belt 68 through the photoconductor drum 62 of the one image forming unit 20 will not be transferred onto the photoconductor drum 62 of each of the downstream image forming units 20 even when the reversely transferred developing agent reaches the transfer position of the each of the downstream image forming units 20.

In the above described removal processing of reversely transferred developing agent, the reversely transferred developing agent reversely transferred from the recording paper 3 to the photoconductor drum 62 and attached to the developing roller 52 is removed by performing so-called solid printing when the amount of the attached reversely transferred developing agent exceeds the predetermined value.

When the charging amount of the reversely transferred developing agent is higher than the charging amount of an ordinary developing agent housed in the developing unit 51, the reversely transferred developing agent has an increased adherence to the developing roller 52 compared with the ordinary developing agent, and therefore remains on the developing roller 52 without being collected into the developing agent hopper 56. By solid printing, the reversely transferred developing agent on the developing roller 52 is used for visualization of the electrostatic latent image (the electrostatic latent image by entire surface exposure) and is removed from the developing roller 52.

However, solid printing is not the only one method of removing the reversely transferred developing agent attached to the developing roller 62. For example, it may be possible to collect the reversely transferred developing agent attached to the developing roller 52 into the developing agent hopper 56 by rotating the developing roller 52 and the supply roller 32 when an electrostatic latent image is not formed on the photoconductor drum 62.

Specifically, the photoconductor drum 62 is charged with the charger 31, and developing operation is performed without exposure with the scanner unit 41. Then, the developing roller 52 is rotated without developing agent applied by the developing roller to the surface of the photoconductor drum 62. The reversely transferred developing agent attached to the developing roller 52 is collected into the developing agent hopper 56 through the operation of the supply roller 32 and others, along with a developing agent of a color to be originally applied by the developing roller 52. Thus, the reversely transferred developing agent attached to the developing roller 52 may be removed.

The flow of reversely transferred developing agent removal processing will now be described with reference to FIG. 8, which shows a flowchart of the processing of removal of reversely transferred developing agent as a subroutine called from FIG. 3.

The main flow shown in FIG. 3, which is the same as in the case of removal of reversely transferred developing agent by transfer onto the recording paper 3, will not be described here.

Figure 8:
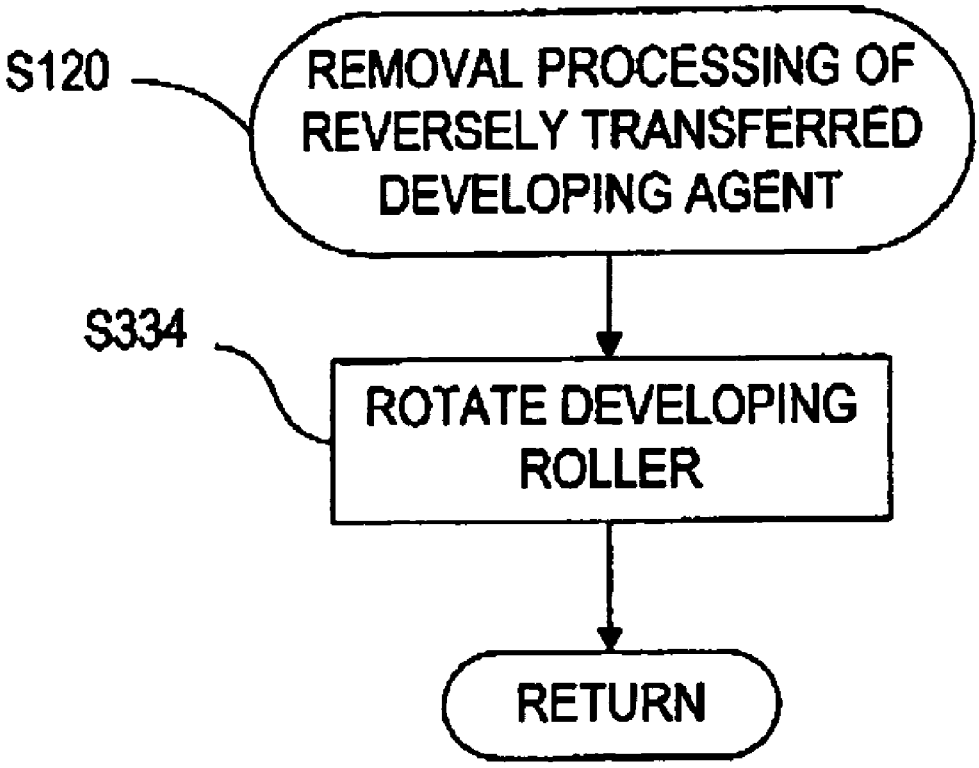
FIG. 8 is a flowchart of a third reversely transferred developing agent removal processing as a subroutine called from the main processing in FIG. 3.

In the processing of removal of reversely transferred developing agent shown in FIG. 8, the processing proceeds to S334 without supplying the recording paper 3.

In S334, the developing roller 52 of each of the image forming units 20 is rotated, and thereby the reversely transferred developing agent attached to the surface of the developing roller 62 is collected into the developing agent hopper 56. After rotation of the developing roller 52 for a time period required for collection of the reversely transferred developing agent into the developing agent hopper 56, the processing returns from the subroutine, and is terminated.

According to the present modification, as described above, the reversely transferred developing agent attached to the surface of the developing roller 52 is removed by collecting the same into the developing agent hopper 56. Therefore, it is possible to prevent color change by the reversely transferred developing agent, thereby to prevent image deterioration at the time of printing.

In the present modification, the reversely transferred developing agent attached to the surface of the developing roller 52 is collected while maintaining the abutment of the photoconductor drum 62 and the developing roller 52. However, it may be possible to collect the reversely transferred developing agent by rotating the developing roller 52 only, while separating the photoconductor drum 62 and the developing roller 52 from each other.

Figure 9:
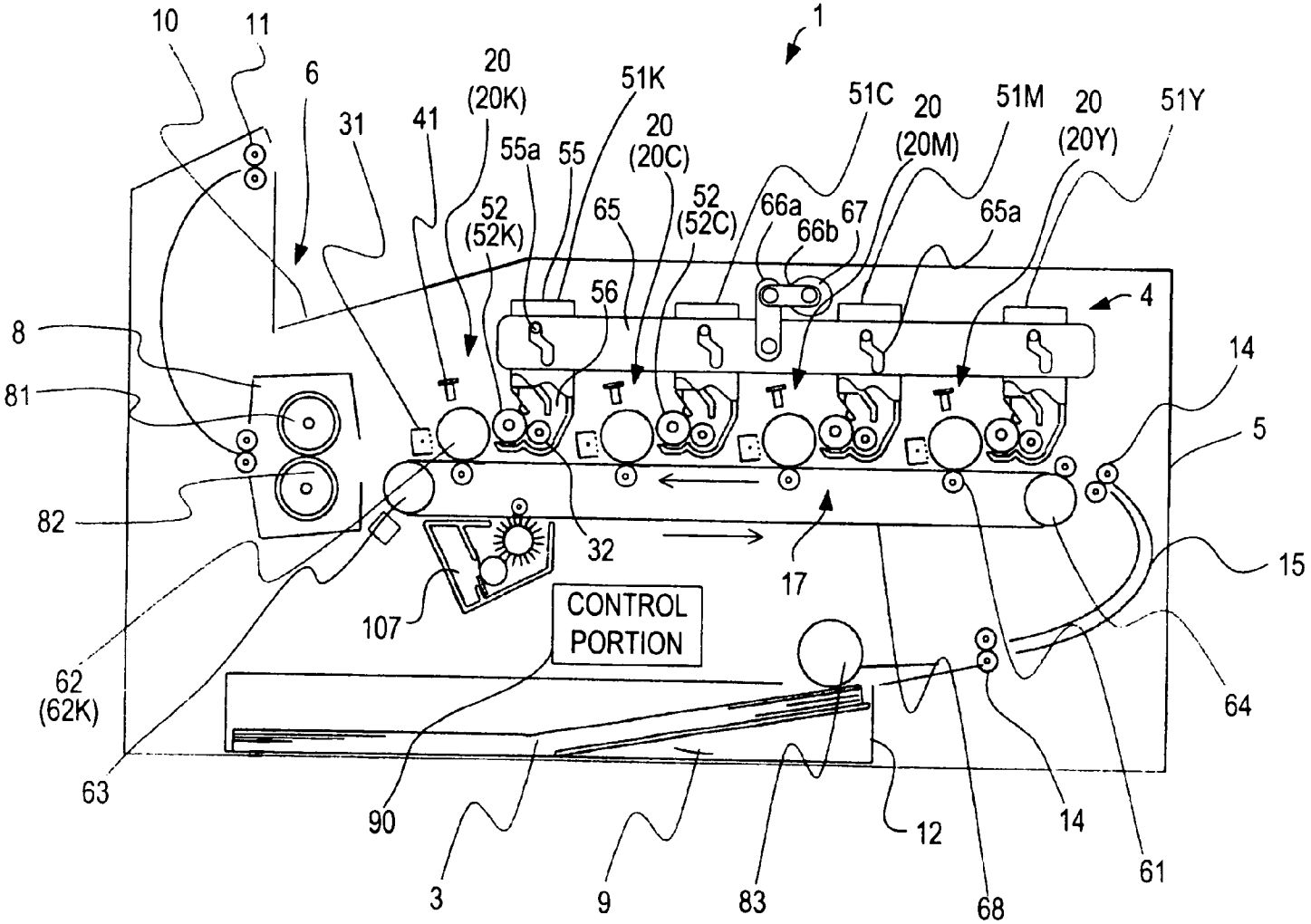
FIG. 9 is a diagrammatic cross-sectional view showing the overall structure of a color laser printer including a mechanism that separates a photoconductor drum from a developing roller.

Specifically, as shown in FIG. 9, the developing units 51M, 51C, 51Y, 51K are supported to be movable in a horizontal direction such that the developing roller 52 of each of the developing units 51M, 51C, 51Y, 51K may be separated from the photoconductor drum 62 by a pair of motion members 65 provided so as to extend over all the developing units 51M, 51C, 51Y, 51K. Only one of the pair of motion members 65 is shown in FIG. 9 and will be described below for simplification purposes. The developing roller 52 is separated from the photoconductor drum 62 by the motion member 65 when required.

The motion member 65 which includes a plate-like member having a length over all the developing units 51M, 61C, 51Y, 51K is supported by a not-shown guide mechanism so as to be movable in upper and lower directions. The motion member 65 is provided with four guide holes 65*a* each having a substantially crank-like shape including a vertical groove along the longitudinal direction of the motion member 65. A shaft 55*a* provided to a lateral side of each of the development casings 55 is fitted into each of the guide holes 65*a*.

A link 66*a* is rotatably attached to a center portion (in the figure) of the motion member 65 perpendicular to and upward from the motion member 65. Another link 66*b* is rotatably attached to an end of the link 66*a* so as to be perpendicular to the link 61*a*. A motor (or a rotating solenoid) 67 is provided to an end of the link 66*b*. The rotating force of the motor 67 is transmitted to the motion member 66 through the links 66*a* and 66*b* so as to move the rotation member 65 in upper and lower directions.

The control portion 90 is designed to output instruction signals to control the rotating direction of the motor 67, and thereby the motion member 65 is moved in upper and lower directions in accordance with the instruction signals from the control portion 90.

When the motion member 65 is moved in an upper direction in accordance with an instruction by the control portion 90, the guide hole 65*a* is shifted in an upper direction. Then, the shaft 55*a* of the development casing 55 is moved rightward along the substantially crank-like shape of the guide hole 65*a*, and the developing roller 62 is separated from the photoconductor drum 62. In contrast, when the motion member 65 is moved in a lower direction, the developing roller 52 is brought into contact with the photoconductor drum 62.

By separating the photoconductor drum 62 from the developing roller 52 using to the above mechanism, it is possible to collect the reversely transferred developing agent attached to the surface of the developing roller 52 into the developing agent hopper 56 without charging the photoconductor drum 62 with the charger 31, or performing exposure with the scanner unit 41. Thus, the reversely transferred developing agent attached to the surface of the developing roller 52 can be removed.

The flow of reversely transferred developing agent removal processing will now be described with reference to FIG. 10, which shows a flowchart of the processing of removal of reversely transferred developing agent as a subroutine called from FIG. 3.

The main flow shown in FIG. 3, which is the same as in the case of removal of reversely transferred developing agent by transfer onto the recording paper 3, will not be described here.

Figure 10:
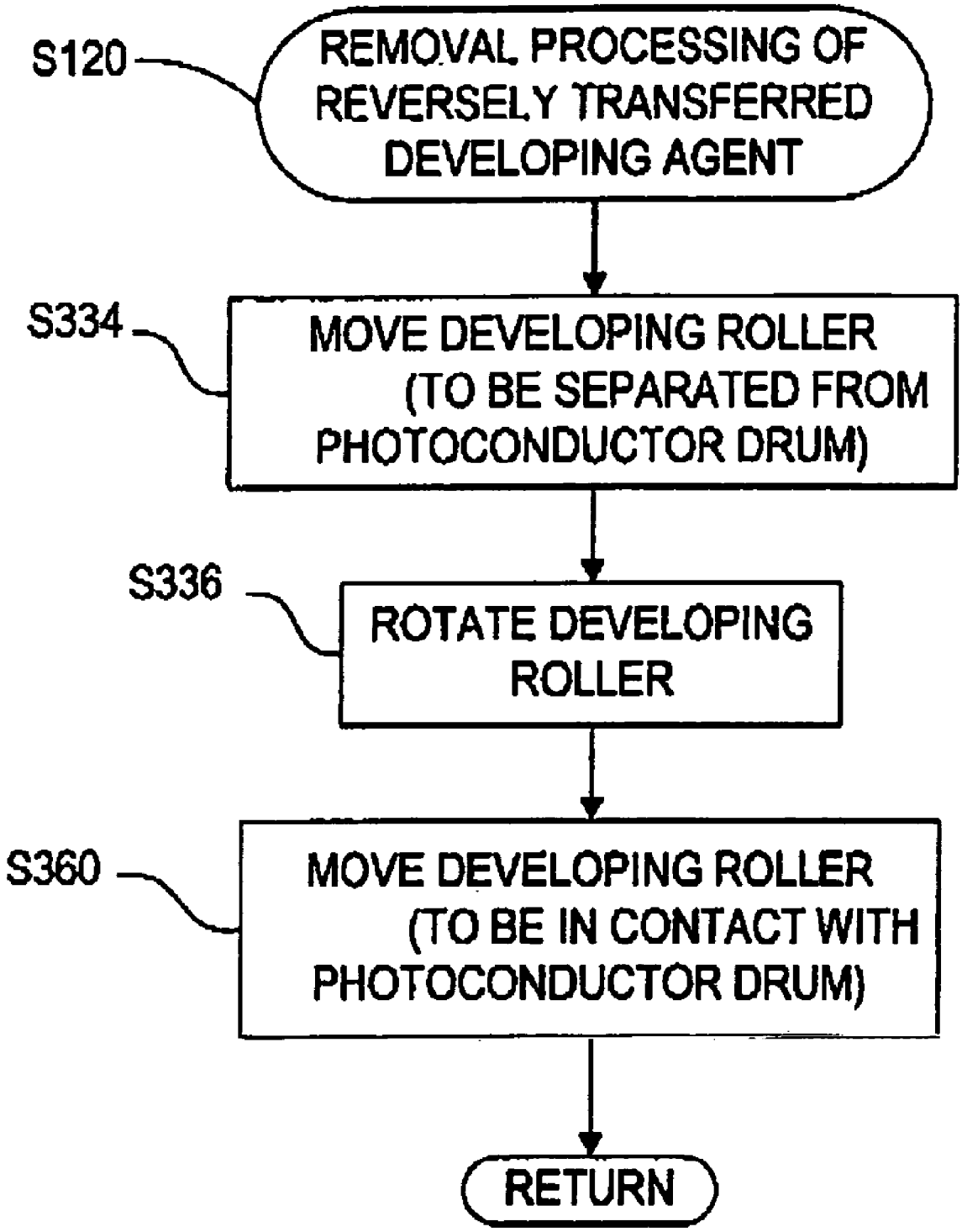
FIG. 10 is a flowchart of a fourth reversely transferred developing agent removal processing as a subroutine called from the main processing in FIG. 3.

In the processing of removal of reversely transferred developing agent shown in FIG. 10, the processing proceeds to S334 without supplying the recording paper 3.

In S334, the motor 67 is actuated to move the developing roller 62 so as to be separated from the photoconductor drum 62, and the processing proceeds to S336.

In S336, the developing roller 52 is rotated, and the reversely transferred developing agent attached to the surface of the developing roller 52 is collected into the developing agent hopper 56, and the processing proceeds to S360.

In S360, the motor 67 is actuated to move the developing roller 52 so as to be in contact with the photoconductor drum 62, and the processing returns from the subroutine and is terminated.

According to the present modification, as described above, the reversely transferred developing agent attached to the surface of the developing roller 52 is removed by rotating only the developing roller 52 and collecting the reversely transferred developing agent into the developing agent hopper 56. Therefore, it is possible to prevent color mixture by the reversely transferred developing agent, thereby to prevent image deterioration at the time of printing. Also, deterioration of the photoconductor drum 62 may be reduced since the photoconductor drum 62 is not charged, and the lifetimes of the photoconductor drum 62 and the conveyer belt 68 can be prolonged since there is no wear due to friction therebetween. Furthermore, the lifetime of the scanner unit 41 can be prolonged since the scanner unit 41 is not actuated.

Second Embodiment

A description will be made about a second embodiment in which the present invention is applied to a four-cycle type color laser printer 2. Since the color laser printer 2 generally includes the same components as in the color laser printer 1 of the first embodiment, the description will be made on differences between the two embodiments.

Figure 11:
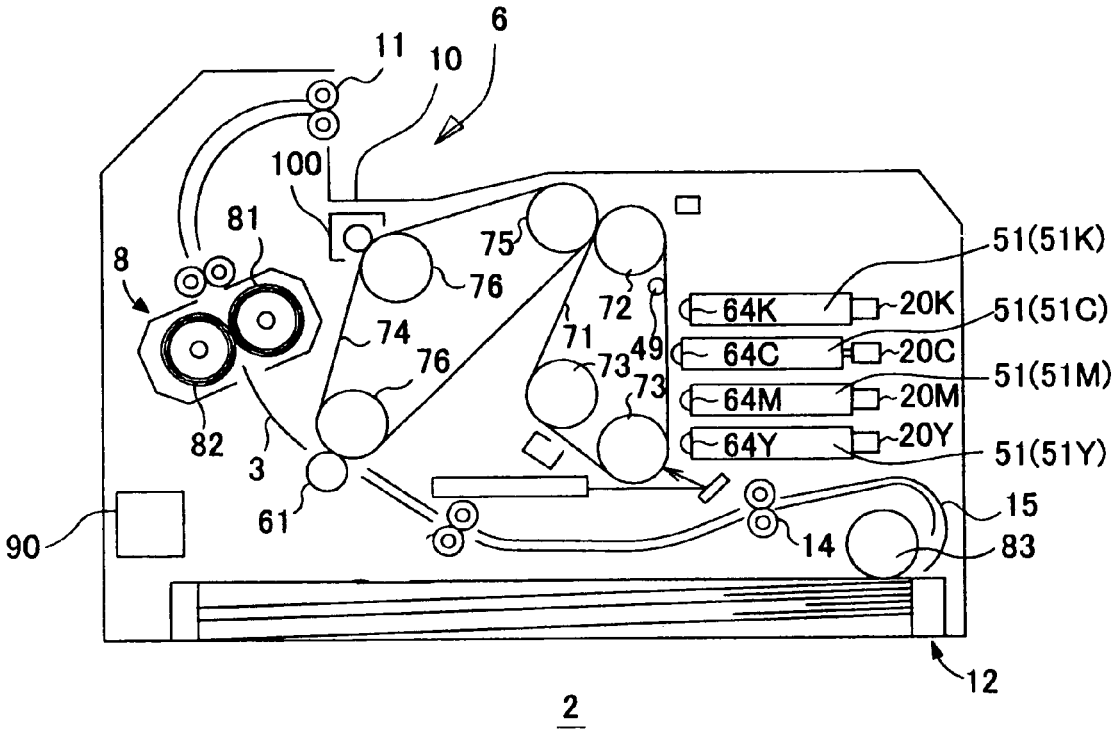
FIG. 11 is a diagrammatic cross-sectional view showing the overall structure of a four-cycle type color laser printer of a second embodiment.

In the color laser printer 2 as shown in FIG. 11, an image forming operation includes forming a developing agent image by applying developing agent from developing units 51 to an electrostatic latent image formed on an after-mentioned photoconductor belt 71, and forming an image by transferring the formed developing agent image onto an after-mentioned intermediate transfer belt 74. By repeating the image forming operation four times for the colors of yellow(Y), magenta(M), cyan(C), and black(K), color images are formed on the surface of the intermediate transfer belt 74. Then the intermediate transfer belt 74 carrying the color images is abutted against the recording paper 3 conveyed by the conveyer roller 14 or the like, thereby to form a color image on the surface of the recording paper 3.

The photoconductor belt 71 is wound around a photoconductor belt drive roller 72 and two photoconductor belt follower rollers 73 so as to form a triangular shape. The photoconductor belt 71 is arranged such that the outer surface of the photoconductor belt 71 in a wound state may be in facing contact with the developing units 51.

At least one of the photoconductor belt follower rollers 73 is designed to be pulled with a spring or the like outward from the triangular shape formed by the photoconductor belt 71, in order to apply an appropriate tension to the photoconductor belt 71. When the photoconductor belt follower rollers 73 are rotated by driving of the photoconductor belt drive roller 72, the photoconductor belt 71 is turned around to be in facing contact with the developing units 51 between the photoconductor belt drive roller 72 and the photoconductor belt follower roller 73.

The intermediate transfer belt 74 wound around an intermediate transfer belt drive roller 75 and two intermediate transfer belt follower rollers 76 so as to form a triangular shape. The intermediate transfer belt 74 is arranged such that the outer surface of the intermediate transfer belt 74 in a wound state is in contact with the photoconductor belt 71 on the intermediate transfer belt drive roller 75.

At least one of the intermediate transfer belt follower rollers 76 is designed to be pulled with a spring or the like outward from the triangular shape formed by the intermediate transfer belt 74 outward by, in order to apply an appropriate tension to the intermediate transfer belt 74.

A developing agent collection device 100 is disposed so as to face the intermediate transfer belt follower rollers 76. The developing agent collection device 100 is designed to collect developing agent remaining on the surface of the intermediate transfer belt 74 instead of being transferred from the intermediate transfer belt 74 onto the recording paper 3.

When the intermediate transfer belt 74 is rotated by driving of the intermediate transfer belt drive roller 75, the intermediate transfer belt 74 is turned around in a direction opposite to the turning direction of the photoconductor belt 71 in contact with the photoconductor belt 71 on the photoconductor belt drive roller 72.

According to the color laser printer 2 configured as above, so-called solid printing is performed not on the recording paper, as in the first embodiment, but on the intermediate transfer belt 74. Specifically, the control portion 90 makes the charger 31 charge the photoconductor drum 62, and makes the scanner unit 41 irradiate a laser light on the entire surface of the photoconductor drum 62 to form a developing agent image on the entire surface of the photoconductor drum 62. Subsequently, the developing agent image is transferred onto the intermediate transfer belt 74. Then, the developing agent transferred onto the intermediate transfer belt 74 is collected by the developing agent collection device 100.

This facilitates removal of reversely transferred developing agent without using the recording paper 3, resulting in a reduction in the consumption of the recording paper 3.

The flow of reversely transferred developing agent removal processing in the control portion 90 will not be described in detail since it is to be understood by replacing the conveyer belt 68 with the intermediate transfer belt 74 in the processing of removing reversely transferred developing agent by transfer onto the conveyer belt 68 shown in FIGS. 3, 4, and 6.

According to the second embodiment, in which solid printing is performed not on the recording paper 2 or the conveyer belt 68, but on the intermediate transfer belt 74, may achieve the same advantage as in the first embodiment.

Although the first embodiment is a direct tandem color printer and the second embodiment is a four-cycle type color printer, it is to be understood that the same advantage may be achieved even when the present invention is applied to an intermediate transfer tandem color printer provided with an intermediate transfer belt.

What is claimed is:

1. An image forming apparatus comprising:

at least one image carrier that carries an electrostatic latent image;

an electrostatic latent image forming device that forms an electrostatic latent image on a surface of the image carrier;

a plurality of developing devices, each having a developing agent carrier, each of the plurality of developing devices applying the developing agent on the surface of the image carrier on which the electrostatic latent image is formed by the electrostatic latent image forming device such that a developing agent image is formed on the surface of the image carrier;

a transfer device that transfers the developing agent image on the surface of the image carrier formed by each of the plurality of developing devices onto a transfer target medium, a part of the developing agent transferred to the transfer target medium being reversely transferred from the transfer target medium to the image carrier and being collected on a surface of the developing agent carrier;

a reversely transferred developing agent amount estimating device that estimates each amount of the reversely transferred developing agent on the surface of the developing agent carrier; and a reversely transferred developing agent removing device that removes the collected reversely transferred developing agent from the surface of the developing agent carrier when the amount of the reversely transferred developing agent estimated by the reversely transferred developing agent removing device exceeds a predetermined value.

2. The image forming apparatus according to claim 1, wherein each of the developing devices further includes a developing agent container that contains the developing agent.

3. The image forming apparatus according to claim 2, wherein the reversely transferred developing agent removing device transfers the reversely transferred developing agent on the surface of the developing agent carrier to the surface of the image carrier, the collected reversely transferred developing agent on the surface of the image carrier being further transferred to the transfer target medium.

4. The image forming apparatus according to claim 3, wherein the at least one image carrier is a plurality of image carriers, each of the plurality of image carriers being corresponding to each of the plurality of developing devices.

5. The image forming apparatus according to claim 4, wherein the transfer target medium is a moving body that conveys a recording medium.

6. The image forming apparatus according to claim 4, wherein the transfer target medium is an intermediate transfer body that holds the developing agent images formed on the plurality of image carriers, the developing agent images held on the intermediate transfer body being transferred onto a recording medium.

7. The image forming apparatus according to claim 4, wherein the reversely transferred developing agent removing device includes a separating device; and when the amount of the reversely transferred developing agent collected by one developing device of the plurality of developing devices exceeds the predetermined value, the separating device separates the image carriers, corresponding to remaining developing devices of the plurality of developing devices other than the one developing device, from the transfer target medium.

8. The image forming apparatus according to claim 3, wherein the transfer target medium is a recording medium.

9. The image forming apparatus according to claim 5, wherein the reversely transferred developing agent removing device includes a separating device that separates image carriers, corresponding to developing devices other than a developing device having an amount of reversely transferred developing agent exceeding a predetermined value, from a moving body.

10. The image forming apparatus according to claim 6, wherein the reversely transferred developing agent removing device includes the separating device that separates image carriers, corresponding to developing devices other the developing device having the amount of reversely transferred developing agent exceeding the predetermined value, from an intermediate transfer body.

11. The image forming apparatus according to claim 2, wherein the reversely transferred developing agent removing device actuates the developing agent carrier so as to transfer the collected reversely transferred developing agent on the surface of the developing agent carrier to the developing agent container.

12. The image forming apparatus according to claim 11, wherein the at least one image carrier is a plurality of image carriers, each of the plurality of image carriers being corresponding to each of the plurality of developing devices.

13. The image forming apparatus according to claim 12, wherein the reversely transferred developing agent removing device includes a separating device; and when the amount of the reversely transferred developing agent collected by at least one developing device of the plurality of developing devices exceeds the predetermined value, the separating device separates at least one developing agent carrier corresponding to the at least one developing device from at least one image carrier corresponding to the at least one developing device.

14. The image forming apparatus according to claim 13, wherein the reversely transferred developing agent removing device actuates the at least one developing agent carrier so as to transfer the collected reversely transferred developing agent on the surface of the at least one developing agent carrier to at least one developing agent container corresponding to the at least one developing agent carrier.

15. The image forming apparatus according to claim 1, wherein the reversely transferred developing agent amount estimating device estimates the amount of the reversely transferred developing agent with respect to at least one developing device in the second or later place in order of image formation among the developing devices by using, as a parameter, at least one of:

a difference in charging capacity between a developing agent of the at least one developing device and a developing agent of a developing device performing development earlier than the at least one developing device, a surface area of an image formed with the developing agent of the developing device performing development before the at least one developing device, and an operating time of the at least one developing device.

16. The image forming apparatus according to claim 15, wherein the reversely transferred developing agent amount estimating device estimates the amount of the reversely transferred developing agent on an assumption that the amount of the reversely transferred developing agent attenuates with passage of the operating time according to a time constant obtained by using the difference in charging capacity.

17. The image forming apparatus according to claim 15, wherein the reversely transferred developing agent amount estimating device estimates the amount of the reversely transferred developing agent by performing calculation only with respect to images formed within a specified time period obtained by using the difference in charging capacity.

18. The image forming apparatus according to claim 15, wherein the developing devices include developing bias applying devices that apply developing biases which determine the amounts of developing agents to be applied to the image carriers between image carriers and the developing devices, and wherein the reversely transferred developing agent amount estimating device estimates the difference in charging capacity based on image formation conditions changed to correct image density at each of the developing devices, and estimates the amount of the reversely transferred developing agent by using the estimated difference in charging capacity as a parameter.

19. The image forming apparatus according to claim 15, wherein the reversely transferred developing agent amount estimating device estimates the difference in charging capacity based on the operating time of the at least one developing device, and estimates the amount of the reversely transferred developing agent by using the estimated difference in charging capacity as a parameter.

20. The image forming apparatus according to claim 15, wherein the reversely transferred developing agent amount estimating device divides an image by a specified surface area, calculates the amount of developing agent per the specified surface area, and uses the calculated amount of developing agent as a parameter to estimate the amount of the reversely transferred developing agent.

21. The image forming apparatus according to claim 20, wherein the specified surface area is a unit pixel of the image, and wherein the reversely transferred developing agent amount estimating device estimates the amount of the reversely transferred developing agent with respect to at least one developing device in the second or later place in order of image formation among the developing devices by using, as a parameter, the amount of developing agent per pixel of the image formed with developing agents of developing devices performing development earlier than the at least one developing device.

22. The image forming apparatus according to claim 1, wherein the reversely transferred developing agent amount estimating device also estimates an amount of the reversely transferred developing agent collected by each of the plurality of developing devices.

* * * * *

UNITED STATES PATENT AND TRADEMARK OFFICE

CERTIFICATE OF CORRECTION

PATENT NO. : 7,239,827 B2
APPLICATION NO. : 11/092675
DATED : July 3, 2007
INVENTOR(S) : Toshio Furukawa It is certified that error appears in the above-identified patent and that said Letters Patent is hereby corrected as shown below:

Column 21, line 46: change “the” to --a--.
Column 21, line 48: change first occurrence of “the” to --than a-- and second occurrence of “the” to --an--.
Column 21, line 49: change “the” to --a--.
Column 21, line 50: change “an” to --the--.

Signed and Sealed this

Thirtieth Day of October, 2007

JON W. DUDAS
*Director of the United States Patent and Trademark Office*